US007633330B2

(12) United States Patent
Ogiwara et al.

(10) Patent No.: US 7,633,330 B2
(45) Date of Patent: Dec. 15, 2009

(54) REFERENCE VOLTAGE GENERATION CIRCUIT

(75) Inventors: Ryu Ogiwara, Yokohama (JP); Daisaburo Takashima, Yokohama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 11/934,970

(22) Filed: Nov. 5, 2007

(65) Prior Publication Data

US 2008/0116965 A1 May 22, 2008

(30) Foreign Application Priority Data

Nov. 6, 2006 (JP) ..... 2006-300535

(51) Int. Cl.
*G05F 1/10* (2006.01)

(52) U.S. Cl. ..... 327/536

(58) Field of Classification Search ..... 327/512, 327/513, 539

See application file for complete search history.

(56) References Cited

U.S. PATENT DOCUMENTS 5,629,611 A * 5/1997 McIntyre ..... 323/313
6,018,235 A * 1/2000 Mikuni ..... 323/313
6,037,833 A * 3/2000 Ang ..... 327/543
6,091,285 A * 7/2000 Fujiwara ..... 327/539
6,160,391 A * 12/2000 Banba ..... 323/313
6,452,437 B1 * 9/2002 Takeuchi et al. ..... 327/513
6,677,808 B1 * 1/2004 Sean et al. ..... 327/539
7,199,646 B1 * 4/2007 Zupcau et al. ..... 327/539
7,215,183 B2 * 5/2007 Nakada ..... 327/539
7,256,643 B2 * 8/2007 Pan et al. ..... 327/539
7,456,678 B2 * 11/2008 Passerini et al. ..... 327/538
7,495,505 B2 * 2/2009 Chang et al. ..... 327/539
7,514,987 B2 * 4/2009 Lin ..... 327/539
2007/0080740 A1 * 4/2007 Berens et al. ..... 327/539

OTHER PUBLICATIONS

Hironori Banba, et al., "A CMOS Bandgap Reference Circuit with Sub-1-V Operation", IEEE Journal of Solid-State Circuits, vol. 34, No. 5, May 1999, pp. 670-674.

J. Doyle, et al., "A CMOS Subbandgap Reference Circuit With 1-V Power Supply Voltage", IEEE Journal of Solid-State Circuits, vol. 39, No. 1, Jan. 2004, pp. 252-255.

G. Giustolisi, et al., "A Low-Voltage Low-Power Voltage Reference Based on Subthreshold MOSFETs", IEEE Journal of Solid-State Circuits, vol. 38, No. 1, Jan. 2003, pp. 151-154.

Peter Hazucha, et al., "Low Voltage Buffered Bandgap Reference", Proceedings of the 8th International Symposium on Quality Electronic Design (ISQED'07), IEEE Computer Society, 2007, 5 Pages.

* cited by examiner

*Primary Examiner*—Jeffrey S Zweizig
(74) *Attorney, Agent, or Firm*—Oblon, Spivak, McClelland, Maier & Neustadt, L.L.P.

(57) ABSTRACT

According to an aspect of the present invention, there is provided a reference voltage generation circuit including: a first transistor having a first gate, a first source and a first drain; a second transistor having a second gate connected to the first gate, a second source connected to the first source and a second drain; a first diode connected between a ground and a V− node; a first resistor connected between the V− node and the first drain; a second diode and a second resistor connected between the ground and a V+ node; a third resistor connected between the V+ node and the first drain; an operational amplifier including input ports connected to the V+ node and the V− node and an output port connected to the first gate and the second gate; and a fourth resistor connected between the ground and the second drain.

7 Claims, 11 Drawing Sheets

REFERENCE VOLTAGE GENERATION CIRCUIT

CROSS-REFERENCE TO RELATED APPLICATIONS

The entire disclosure of Japanese Patent Application No. 2006-300535 filed on Nov. 6, 2006 including specification, claims, drawings and abstract is incorporated herein by reference in its entirety.

BACKGROUND OF THE INVENTION

1. Field of the Invention

An aspect of the present invention relates to a semiconductor integrated circuit and in particular to a reference voltage generation circuit for outputting a reference voltage.

2. Description of the Related Art

A band gap reference (BGR) circuit for outputting a given reference voltage if the ambient temperature fluctuates by using a band gap of a semiconductor is widely used with a semiconductor integrated circuit (LSI) of memory, etc. A BGR circuit that can operate on a low power supply voltage is demanded as the power supply voltage of an LSI lowers. Thus, a BGR circuit that can output a reference voltage on power supply voltage 1V or less is proposed (for example, refer to Hironori Banba et al. "ACMOS bandgap reference circuit with sub-1-v operation," USA electronics and communications engineer association journal of solid-state circuits, vol. 34, number 5, May 1999).

The above proposed BGR circuit operates on a power supply voltage of 1V or less by lessening the threshold voltage of MOS transistors. However, the above proposed BGR circuit involves a problem of occurrence of variations in the reference voltage caused by the threshold voltage variations of PMOS transistors (p-channel MOS transistors). Especially, in an integrated circuit having a large variation in a threshold voltage of transistors, such as a ferroelectric memory, the BGR voltage varies with transistor manufacturing variations.

SUMMARY OF THE INVENTION

According to an aspect of the present invention, there is provided a reference voltage generation circuit including: a first transistor including: a first gate, a first source, and a first drain; a second transistor including: a second gate connected to the first gate, a second source connected to the first source, and a second drain; a first diode connected between a ground level and a V− node; a first resistor connected between the V− node and the first drain; a second diode connected between the ground level and a Vdio node; a second resistor connected between the Vdio node and a V+ node; a third resistor connected between the V+ node and the first drain; a first operational amplifier including: a first plus input port connected to the V+ node, a first minus input port connected to the V− node, and a first output port connected to the first gate and the second gate; a fourth resistor connected between the ground level and the second drain; and an output terminal disposed between the second drain and the fourth resistor.

According to another aspect of the present invention, there is provided a reference voltage generation circuit including: a reference current generation circuit including: an output terminal from which a temperature-independent current is output; a third transistor including: a third gate, a third source, and a third drain connected to the output terminal; a second operational amplifier including: a second plus input port connected to the output terminal, a second minus input port connected to a power supply voltage via a variable resistor that is disposed between the power supply voltage and a ground level, and a second output port connected to the third gate; and a fourth resistor connected between the output terminal and the ground level.

BRIEF DESCRIPTION OF THE DRAWINGS

Embodiment may be described in detail with reference to the accompanying drawings, in which.

DETAILED DESCRIPTION OF THE INVENTION

Figure 1:
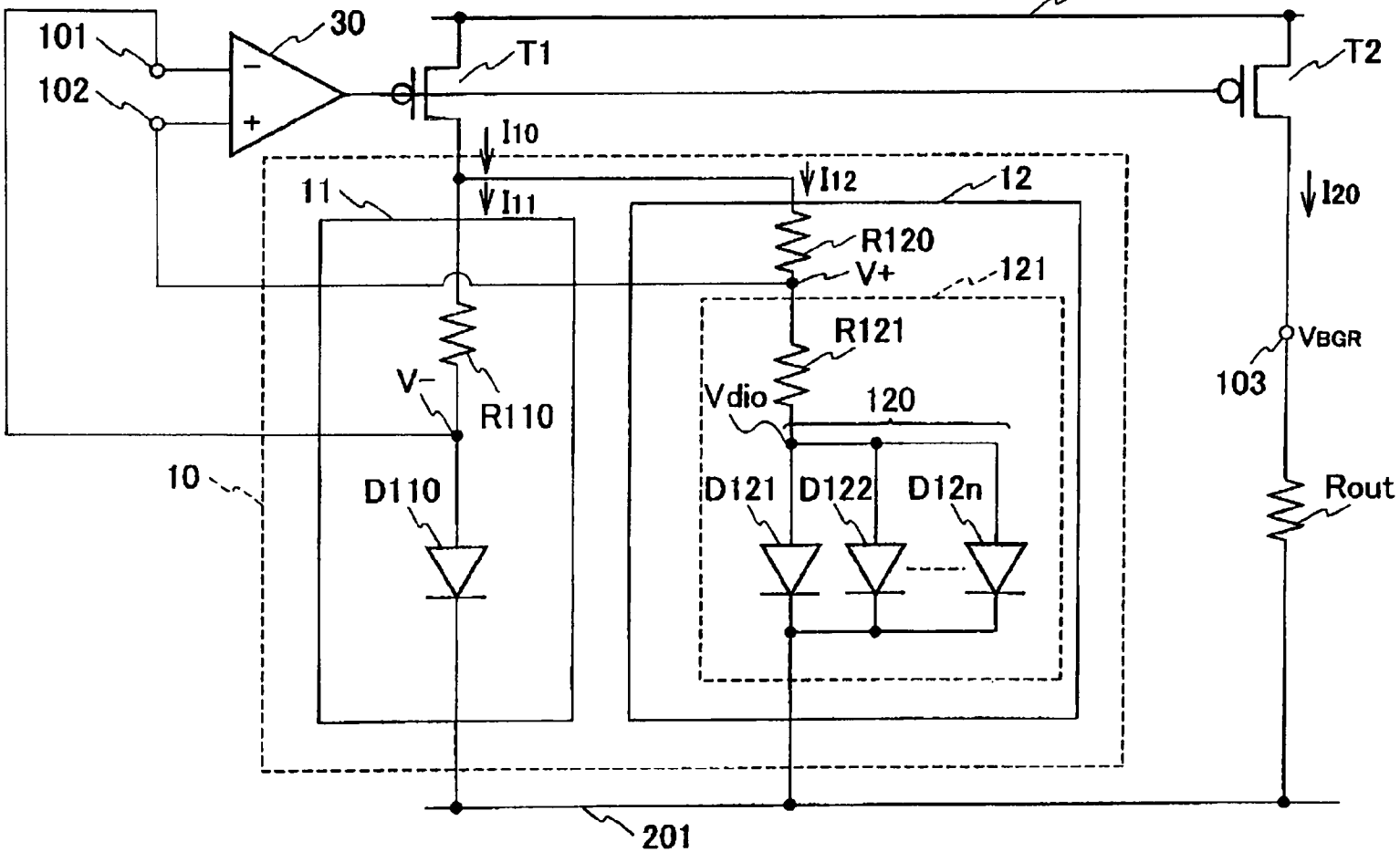
FIG. 1 is a schematic drawing showing the configuration of a reference voltage generation circuit according to a first embodiment.

First and third embodiments will be discussed with reference to the accompanying drawings. The identical parts or similar parts described below with reference to the accompanying drawings are denoted by the same or similar reference numerals. The following first to third embodiments illustrate apparatus and methods for embodying the technical idea of the invention and the technical idea of the invention does not limit the structures, placement, etc., of components to those described below. Various changes can be added to the technical idea of the invention in the claims.

FIRST EMBODIMENT

A reference voltage generation circuit according to the first embodiment includes a first operational amplifier 30, first and second PMOS transistors T1 and T2 with gate electrodes to which output of the first operational amplifier 30 is input, a circuit block 10 that sets the drain current of the first PMOS transistor T1 to a current $I_{10}$ independent of the temperature, and an output resistor $R_{out}$ connected between a drain electrode of the second PMOS transistor T2 and a ground line 201, and outputs the voltage of a connection node 103 of the drain electrode of the second PMOS transistor T2 and the fourth resistor (output resistor) $R_{out}$ as a reference voltage $V_{BGR}$, as shown in FIG. 1.

The first PMOS transistor T1 and the second PMOS transistor T2 shown in FIG. 1 are PMOS transistors of the same size. A power supply line 200 that supplies power supply voltage VDD is connected to source electrodes of the first PMOS transistor T1 and the second PMOS transistor T2. An output terminal of the first operational amplifier 30 is connected to the gate electrodes. The circuit block 10 is connected to a drain electrode of the first PMOS transistor T1.

The circuit block 10 includes a first diode D110 and a first resistor R110 connected in series in a V− node between the ground level (ground line 201) and the drain electrode of the first PMOS transistor T1. The first resistor R110 is connected at one end to the drain electrode of the first PMOS transistor T1 and is connected at an opposite end to an anode of the first diode D110 in the V− node. A cathode of the first diode D110 is connected to the ground line 201. The circuit block 10 sets the drain current of the first PMOS transistor T1 to the current $I_{10}$ independent of the temperature.

The circuit block 10 also includes a circuit block 121 having a second diode D120 and a second resistor R121 connected in series and a third resistor R120 connected in series in a V+ node between the ground line 201 and the drain electrode of the first PMOS transistor T1. The second diode D120 has a plurality of diodes D121 to D12*n* connected in parallel (where n is an integer of two or more), each of the diodes D121 to D12*n* equaling the first diode D110 in energization area. The third resistor R120 is connected at one end to the drain electrode of the first PMOS transistor T1 and is connected at an opposite end to one end of the second resistor R121 in the V+ node. An opposite end of the second resistor R121 is connected to anodes of the diodes D121 to D12*n*. Cathodes of the diodes D121 to D12*n* are connected to the ground line 201. The third resistor R120 and the first resistor R110 are equal in resistance value.

The circuit operation of the circuit block 10 is as follows: Let currents flowing from the drain electrode of the first PMOS transistor T1 into a circuit block 11 and a circuit block 12 shown in FIG. 1 be a current $I_{11}$ and a current $I_{12}$ respectively. The current $I_{10}$ is the sum of the current $I_{11}$ and the current $I_{12}$. A voltage V− of the V− node is input to a minus input terminal 101 of the first operational amplifier 30 and a voltage V+ of the V+ node is input to a plus input terminal 102 of the first operational amplifier 30. Since the gate voltage of the first PMOS transistor T1 is controlled through the first operational amplifier 30 so that the voltages V− and V+ become equal, inevitably the current $I_{11}$ and the current $I_{12}$ also become equal when the resistance values of the first resistor R110 and the third resistor R120 are same. That is, the current $I_{10}$ is controlled so that the voltage V− of the V− node and the voltage V+ of the V+ node become equal.

The current $I_{11}$ and the current $I_{12}$ are represented by expressions (1) and (2) using a forward voltage Vf1 of the first diode D110, backward saturation current Is of the first diode D110, a forward voltage Vf2 of the second diode D120 (the diodes D121, D122, . . . , D12*n*), Boltzmann's constant k, absolute temperature T, and electric charge q:

$$I_{11}=Is\times\exp\{q\times Vf1/(k\times T)\} \quad (1)$$

$$I_{12}=n\times Is\times\exp\{q\times Vf2/(k\times T)\} \quad (2)$$

Here, VT is defined as in expression (3):

$$VT=(k\times T)/q \quad (3)$$

Since the current $I_{10}$ is controlled so that the voltage V− of the V− node and the voltage V+ of the V+ node become equal, the voltage occurring across the first resistor R110 and the voltage occurring across the third resistor R120 are the same. Thus, expression (4) holds true:

$$I_{11}\times R_{110}=I_{12}\times R_{120} \quad (4)$$

In expression (4), $R_{110}$ and $R_{120}$ are the resistance values of the first resistor R110 and the third resistor R120. From expressions (1) to (4), the forward voltages Vf1 and Vf2 are represented by expressions (5) and (6):

$$Vf1 = VT\times\ln(I_{11}/Is) \quad (5)$$

$$\begin{aligned} Vf2 &= VT\times\ln\{I_{12}/(n\times Is)\} \\ &= VT\times\ln[\{I_{11}/(n\times Is)\}\times(R_{110}/R_{120})] \end{aligned} \quad (6)$$

From expressions (5) and (6), difference dVf between the forward voltage Vf1 and the forward voltage Vf2 is represented by expression (7):

$$dVf=Vf1-Vf2=VT\times 1n(n\times R_{120}/R_{110}) \quad (7)$$

The difference dVf is the voltage occurring across the second resistor R121. This means that expression (8) holds true:

$$dVf=I_{12}\times R_{121} \quad (8)$$

In expression (8), $R_{121}$ is the resistance value of the second resistor R121. From expressions (4) and (8), expression (9) is found:

$$I_{11}\times R_{110}=I_{12}\times R_{120}=R_{120}/R_{121}\times dVf \quad (9)$$

From the forward voltage Vf1 of the first diode D110 and expression (9), voltage Vref of the drain electrode of the first PMOS transistor T1 is represented by expression (10):

$$\begin{aligned} Vref &= Vf1 + R_{120}/R_{121}\times dVf \\ &= Vf1 + R_{120}/R_{121}\times VT\times\ln\{(n\times R_{120}/R_{110})\} \end{aligned} \quad (10)$$

Generally, the forward voltage of a diode has negative dependence on the ambient temperature. For example, the dependence of the forward voltage Vf1 on the ambient temperature is about −2 mV/° C. On the other hand, VT has positive dependence on the ambient temperature. The dependence of VT on the ambient temperature is about +0.086 mV/° C. Thus, the resistance values of the first resistor R110, the third resistor R120, and the second resistor R121 and the integer n are appropriately selected based on expression (10), whereby the voltage Vref of the drain electrode of the first PMOS transistor T1 can be set so that it does not depend on the ambient temperature. If the voltage Vref does not depend on the ambient temperature, the current $I_{10}$ independent of the ambient temperature flows into the first PMOS transistor T1. Since the resistance values of the first resistor R110 and the third resistor R120 are the same, the current $I_{11}$ and the current $I_{12}$ are the same.

The resistance values of the first resistor R110 and the third resistor R120 are set to large values to such an extent that the resistance value variations do not affect the reference voltage $V_{BGR}$. However, to set the reference voltage generation circuit shown in FIG. 1 to low power supply voltage, the range in which the voltage of the power supply line 200 is lowered is limited as much as the voltage drop in the first resistor R110 and the third resistor R120.

In the reference voltage generation circuit according to the first embodiment shown in FIG. 1, the V− node is connected to the minus input terminal 101 of the first operational amplifier 30, the V+ node is connected to the plus input terminal 102 of the first operational amplifier 30, and the current $I_{10}$ is controlled so that the voltages of the V− node and the V+ node become equal. Consequently, the current $I_{10}$ independent of the ambient temperature flows into the first PMOS transistor T1 as previously described. The voltages of the gate electrodes of the first PMOS transistor T1 and the second PMOS transistor T2 are equal and the voltages of the source electrodes of the first PMOS transistor T1 and the second PMOS transistor T2 are equal. Thus, a drain current equal to the current $I_{10}$ of the drain current of the first PMOS transistor T1 flows into the second PMOS transistor T2. This means that the drain current of the second PMOS transistor T2 independent of the ambient temperature flows from the second PMOS transistor T2 into the output resistor $R_{out}$. The output resistor $R_{out}$ has a resistance value of, for example, several mega ohms. Consequently, the reference voltage $V_{BGR}$ that is independent of the ambient temperature is output from the connection node 103.

Figure 2:
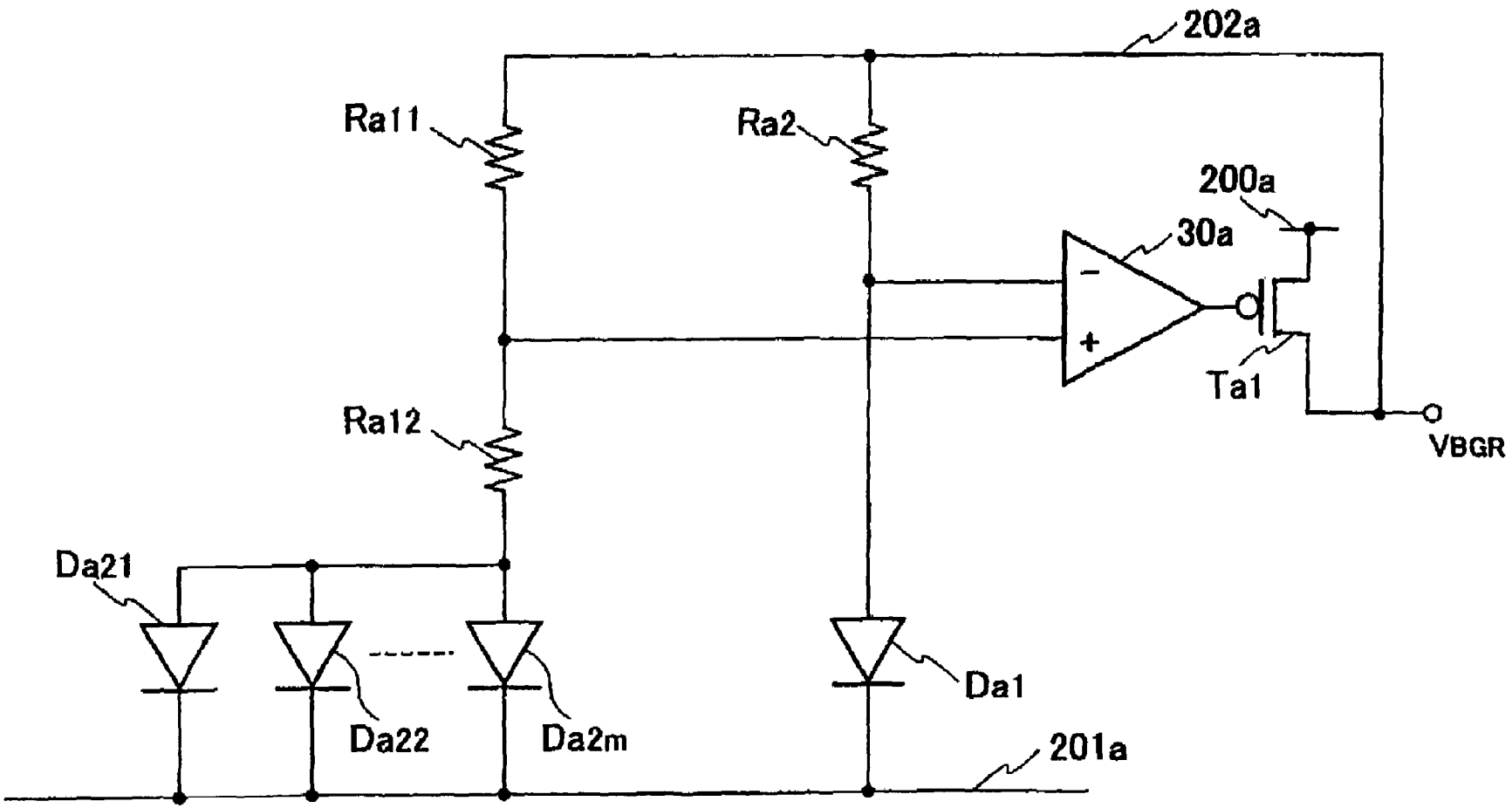
FIG. 2 is a schematic drawing showing a configuration example of a reference voltage generation circuit according to a first comparison example.

A comparison is made between the reference voltage generation circuit according to the first embodiment and reference voltage generation circuits according to first and second comparison example illustrated in FIGS. 2 and 3 as follows:

The reference voltage generation circuit according to the first comparison example shown in FIG. 2 has an operational amplifier 30*a*, a PMOS transistor Ta1, a diode Da1, and diodes Da21 to Da2*m* (where m is an integer of two or more). The energization area of each of the diodes Da21 to Da2*m* is the same as that of the diode Da1.

Cathodes of the diodes Da21 to Da2*m* are connected to a ground line 201*a* and anodes are connected to one end of a resistor Ra12. One end of a resistor Ra11 is connected to an opposite end of the resistor Ra12 and wiring 202*a* is connected to an opposite end of the resistor Ra11. A cathode of the diode Da1 is connected to the ground line 201*a* and a resistor Ra2 is connected between an anode of the diode Da1 and the wiring 202*a*. A plus input terminal of the operational amplifier 30*a* is connected to a connection part of the resistors Ra11 and Ra12 and a minus input terminal is connected to a connection part of the anode of the diode Da1 and the resistor Ra2. An output terminal of the operational amplifier 30*a* is connected to a gate electrode of the PMOS transistor Ta1 and a power supply line 200*a* is connected to a source electrode. The wiring 202*a* is connected to a drain electrode of the PMOS transistor Ta1 and reference voltage $V_{BGR}$ is output as the voltage of the drain electrode of the PMOS transistor Ta1.

By using the fact that the forward voltages of the diode Da1 and the diodes Da21 to Da2*m* have negative dependence on the ambient temperature and that a diffusion current has positive dependence on the ambient temperature, and by adjusting the resistance values of the resistors Ra11, Ra12, and Ra2 appropriately, the reference voltage $V_{BGR}$ with temperature compensated is output from the reference voltage generation circuit shown in FIG. 2.

In the reference voltage generation circuit shown in FIG. 2, since only one PMOS transistor Ta1 is used, the reference voltage $V_{BGR}$ is hard to be affected by the threshold voltage variations of the PMOS transistors. However, the voltage difference between the anodes of the diodes Da21 to Da2*m* and the wiring 202*a* is divided by the resistors Ra11 and Ra12 for setting the voltage of the plus input terminal of the operational amplifier 30*a*. The reference voltage $V_{BGR}$ output using the resistor dividing is, for example, about 1.25 V. This means that the voltage of the power supply line 200*a* cannot be lowered beyond 1.25 V. That is, the reference voltage generation circuit shown in FIG. 2 has the disadvantage in that it is not suited to low-voltage operation.

Figure 3:
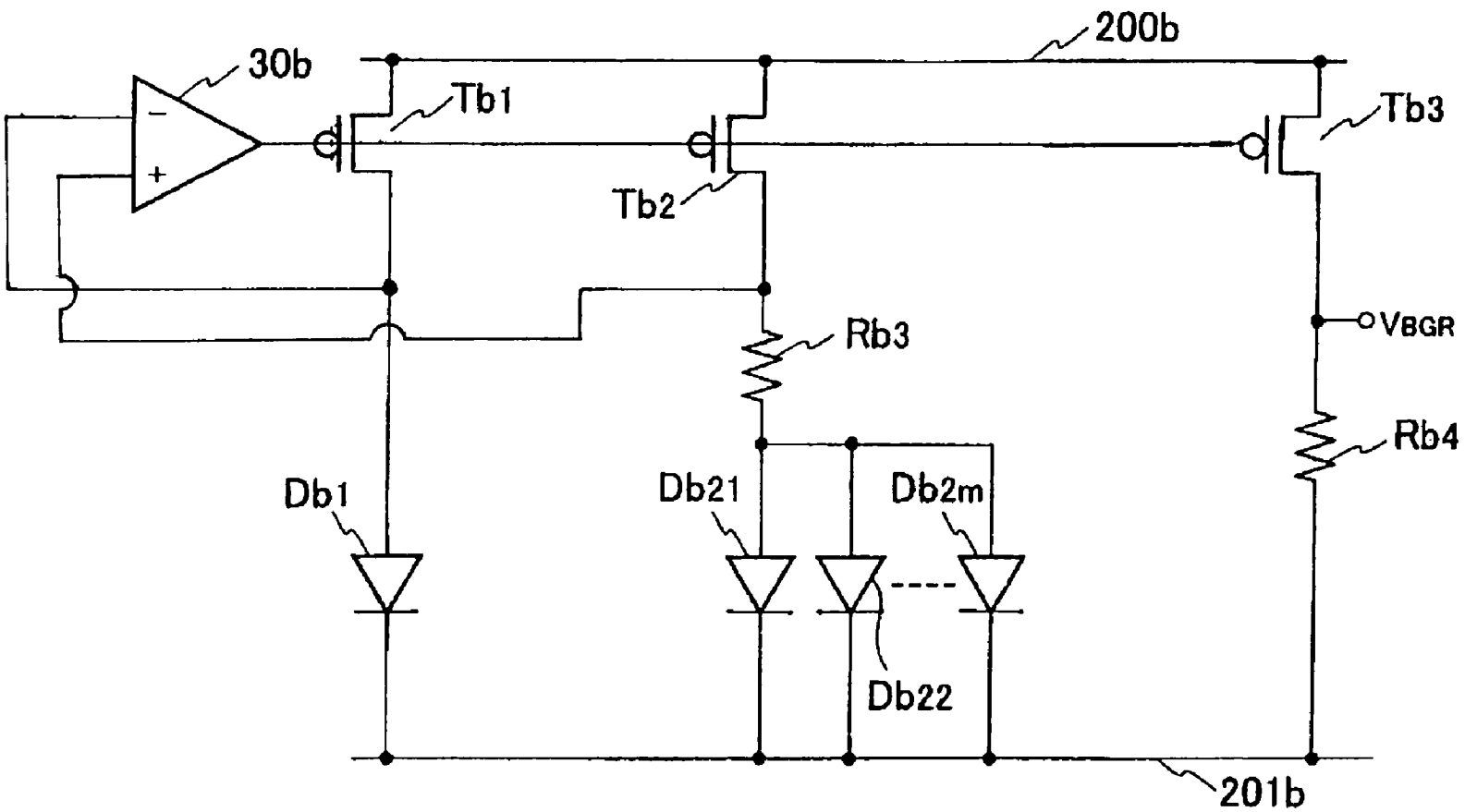
FIG. 3 is a schematic drawing showing a configuration example of a reference voltage generation circuit according to a second comparison example.

The reference voltage generation circuit according to the second comparison example shown in FIG. 3 has an operational amplifier 30*b*, PMOS transistors Tb1 to Tb3, a diode Db1, and diodes Db21 to Db2*m*. The energization area of each of the diodes Db21 to Db2*m* is the same as that of the diode Db1.

Source electrodes of the PMOS transistors Tb1 to Tb3 are connected to a power supply line 200*b* and gate electrodes are connected to an output terminal of the operational amplifier 30*b*. An anode of the diode Db1 is connected to a drain electrode of the PMOS transistor Tb1. A cathode of the diode Db1 is connected to a ground line 201*b*. A drain electrode of the PMOS transistor Tb2 is connected to one end of a resistor Rb3. An opposite end of the resistor Rb3 is connected to anodes of the diodes Db21 to Db2*m*. Cathodes of the diodes Db21 to Db2*m* are connected to the ground line 201*b*. A drain electrode of the PMOS transistor Tb3 is connected to one end of a resistor Rb4 and an opposite end of the resistor Rb4 is connected to the ground line 201*b*.

By using the fact that the forward voltages of the diode Db1 and the diodes Db21 to Db2*m* have negative dependence on the ambient temperature and that a diffusion current has positive dependence on the ambient temperature, and by adjusting the resistance value of the resistor Rb3 appropriately, constant reference voltage $V_{BGR}$ independent of temperature is output from the reference voltage generation circuit shown in FIG. 3. In the reference voltage generation circuit shown in FIG. 3, the voltage of the drain electrode of the PMOS transistor Tb1 and the voltage of the drain electrode of the PMOS transistor Tb2 are input to a minus input terminal and a plus input terminal of the operational amplifier 30*b*. The voltages of the minus input terminal and the plus input terminal of the operational amplifier 30*b* are made equal, whereby the reference voltage $V_{BGR}$ is output from the connection part of the drain electrode of the PMOS transistor Tb3 and the resistor Rb4.

The reference voltage generation circuit according to the second comparison example shown in FIG. 3 does not adopt the configuration of two stages of resistors as in the reference voltage generation circuit according to the first comparison example shown in FIG. 2, and uses the PMOS transistors Tb1 to Tb3 to set the reference voltage $V_{BGR}$. Thus, the reference voltage generation circuit shown in FIG. 3 has the advantage that the voltage of the power supply line 200*b* can be set lower than the voltage of the power supply line 200*a* in the reference voltage generation circuit shown in FIG. 2, for example, can be set to about 0.84 V. However, the reference voltage generation circuit shown in FIG. 3 has the disadvantage in that the reference voltage $V_{BGR}$ is easily affected by the threshold voltage variations of the PMOS transistors because three PMOS transistors are used.

Figure 4:
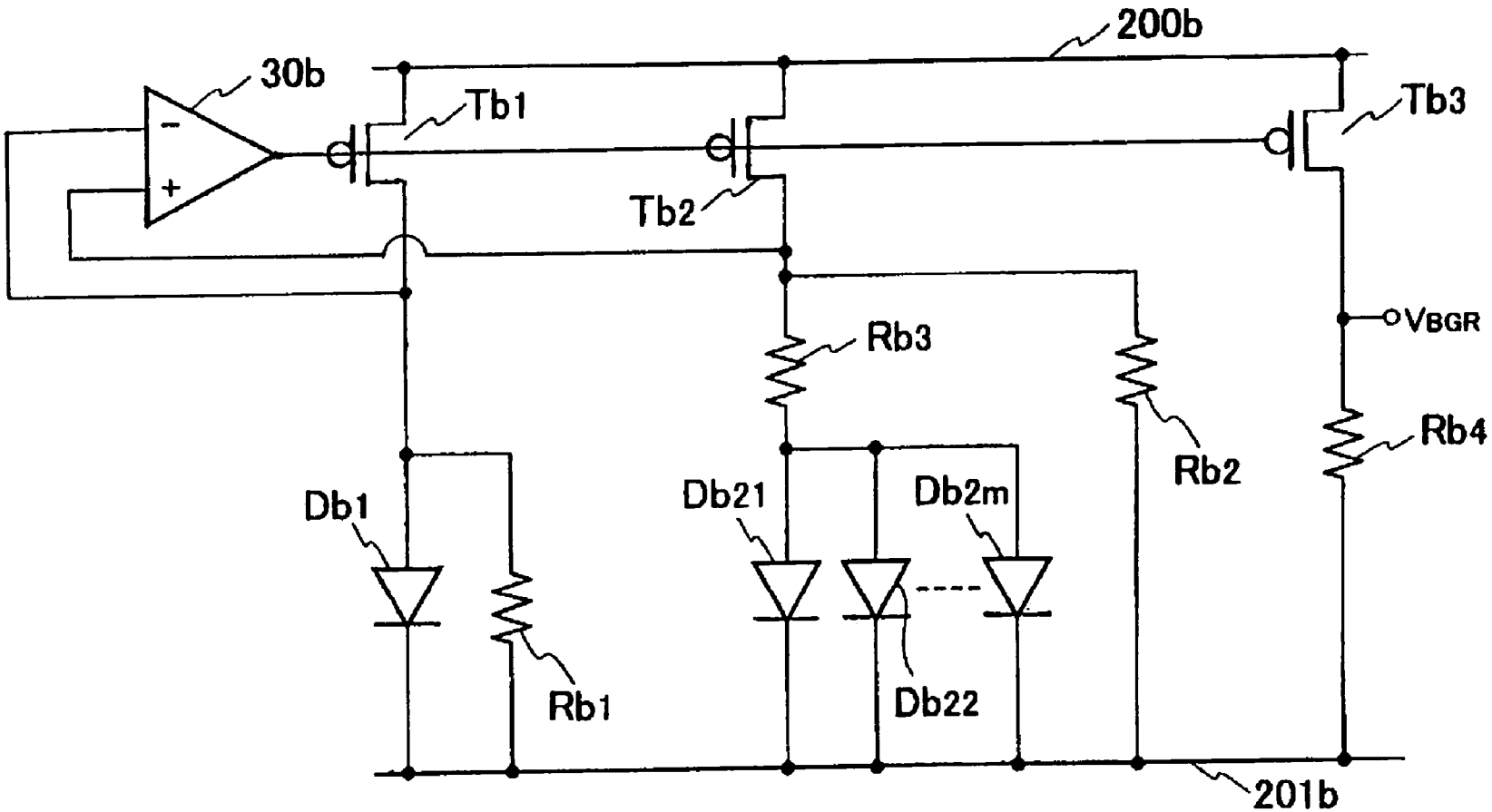
FIG. 4 is a schematic drawing showing a configuration example of a reference voltage generation circuit according to a third comparison example.

A reference voltage generation circuit in FIG. 4 according to a third compassion example is also possible as a configuration similar to that in FIG. 3. The reference voltage generation circuit shown in FIG. 4 differs from the reference voltage generation circuit shown in FIG. 3 in that it further includes resistors Rb1 and Rb2. The resistor Rb1 is connected at one end to a drain electrode of a PMOS transistor Tb1 and is connected at an opposite end to a ground line 201. The resistor Rb2 is connected at one end to a drain electrode of a PMOS transistor Tb2 and is connected at an opposite end to a ground line 201*b*. By adjusting the resistance values of the resistors Rb1 to Rb3 appropriately, reference voltage $V_{BGR}$ with temperature compensated is output from the reference voltage generation circuit shown in FIG. 4.

As compared with the reference voltage generation circuit according to the second comparison example shown in FIG. 3, the reference voltage generation circuit shown in FIG. 1 has the advantage that the number of the used PMOS transistors is smaller by one than that in the reference voltage generation circuit shown in FIG. 3. Thus, the reference voltage generation circuit shown in FIG. 1 has the advantage that the reference voltage $V_{BGR}$ output by the reference voltage generation circuit shown in FIG. 1 is hard to be affected by the threshold voltage variations of the PMOS transistors as compared with the reference voltage generation circuit shown in FIG. 3.

As compared with the reference voltage generation circuit according to the first comparison example shown in FIG. 2, the reference voltage generation circuit shown in FIG. 1 has the advantage that the voltage drop in the first resistor R110 and the third resistor R120 can be made smaller than the voltage drop in the resistor Ra11 in FIG. 2, whereby the reference voltage $V_{BGR}$ can be set to be low (for example, can be set to about 1 V).

As described above, the reference voltage generation circuit according to the first embodiment can operate on low power supply voltage and can output the reference voltage $V_{BGR}$ less affected by the threshold voltage variations of the PMOS transistors.

FIRST MODIFIED EXAMPLE

Figure 5:
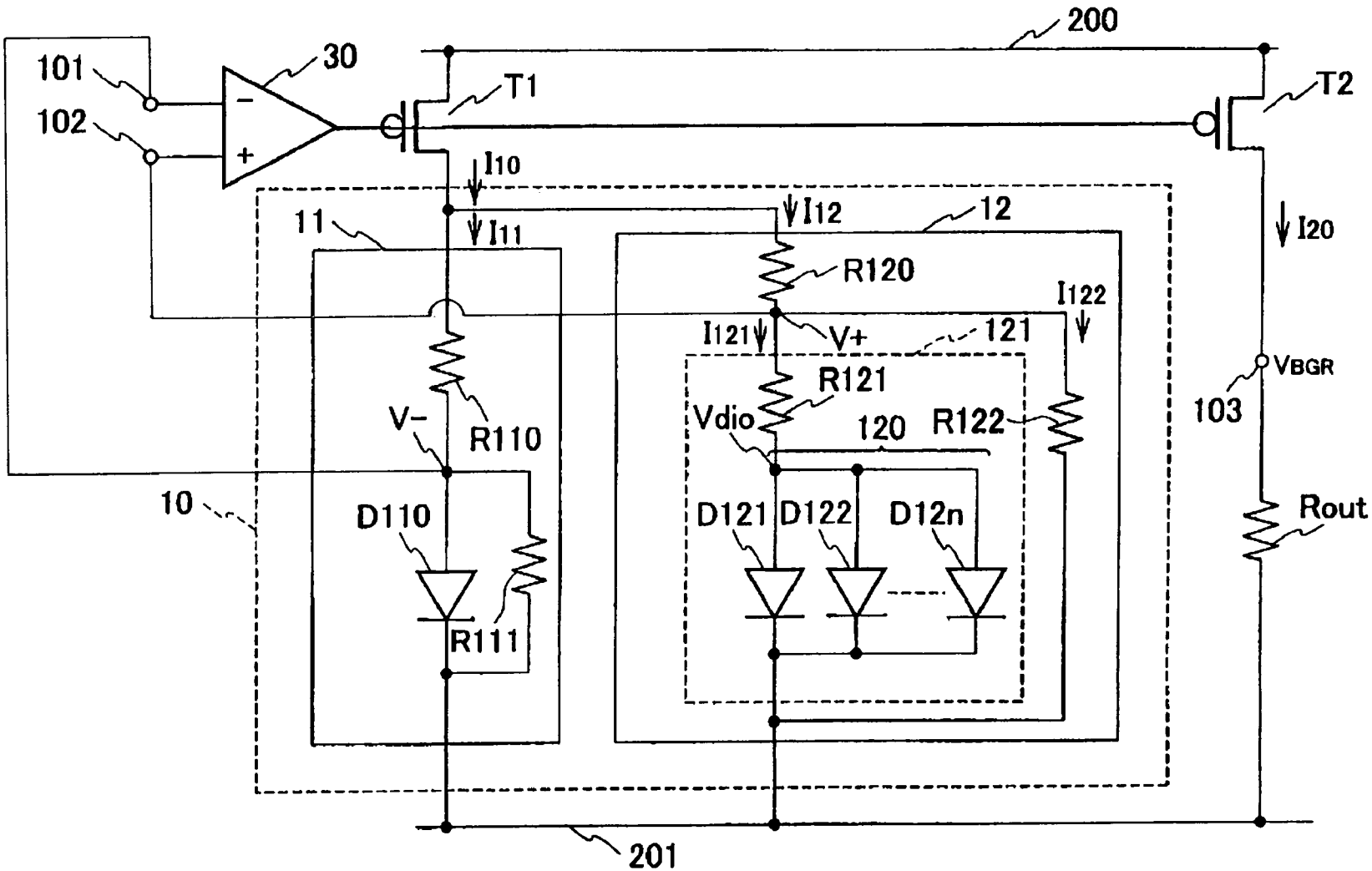
FIG. 5 is a schematic drawing showing the configuration of a reference voltage generation circuit according to a first modified example of the first embodiment.

FIG. 5 shows a reference voltage generation circuit according to a first modified example of the first embodiment. The reference voltage generation circuit shown in FIG. 5 differs from the reference voltage generation circuit shown in FIG. 1 in that it further includes a fifth resistor R111 connected to the first diode D110 in parallel and a sixth resistor R122 connected between the ground line and the V+ node and having a resistance value equal to that of the fifth resistor R111.

In the first modified example of the first embodiment, in addition to the design parameters of the first embodiment shown in FIG. 1, the resistance values of the fifth resistor R111 and the sixth resistor R122 can be adjusted as a design parameter.

SECOND MODIFIED EXAMPLE

Figure 6:
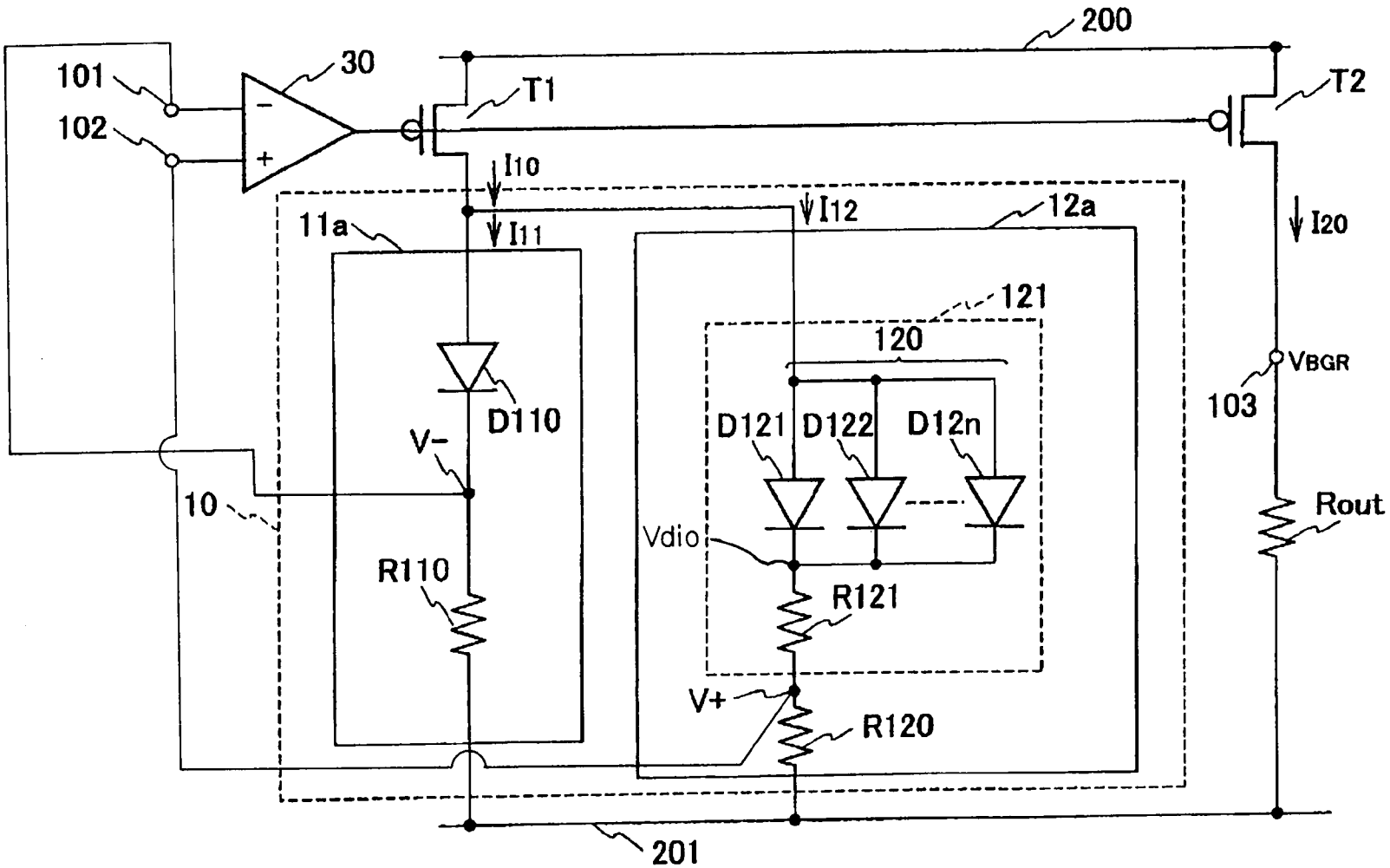
FIG. 6 is a schematic drawing showing the configuration of a reference voltage generation circuit according to a second modified example of the first embodiment.

FIG. 6 shows a reference voltage generation circuit according to a second modified example of the first embodiment. In the reference voltage generation circuit shown in FIG. 6, a first diode D110 and a first resistor R110 are connected in the above mentioned order between a drain electrode of a second PMOS transistor T2 and a ground line 201. This means that the first diode D110 has an anode connected to a drain electrode of a first PMOS transistor T1 and a cathode connected to one end of the first resistor R110. An opposite end of the first resistor R110 is connected to the ground line 201.

Also, in the reference voltage generation circuit shown in FIG. 6, a circuit block 121 and a third resistor R120 are connected in the above mentioned order between the drain electrode of the second PMOS transistor T2 and the ground line 201. This means that diodes D121 to D12*n* have anodes connected to the drain electrode and cathodes connected to one end of the second resistor R121. An opposite end of the second resistor R121 is connected to one end of the third resistor R120 and an opposite end of the third resistor R120 is connected to the ground line 201.

In the reference voltage generation circuit shown in FIG. 6, voltage V− and voltage V+ are made equal by a first operational amplifier 30, whereby the sum of current $I_{11}$ and current $I_{12}$ becomes current $I_{10}$ independent of the ambient temperature. Thus, a drain current equal to the current $I_{10}$ and independent of the ambient temperature flows into the second PMOS transistor T2. Consequently, reference voltage $V_{BGR}$ independent of the ambient temperature is output from a connection node 103 of the reference voltage generation circuit shown in FIG. 6.

SECOND EMBODIMENT

Figure 7:
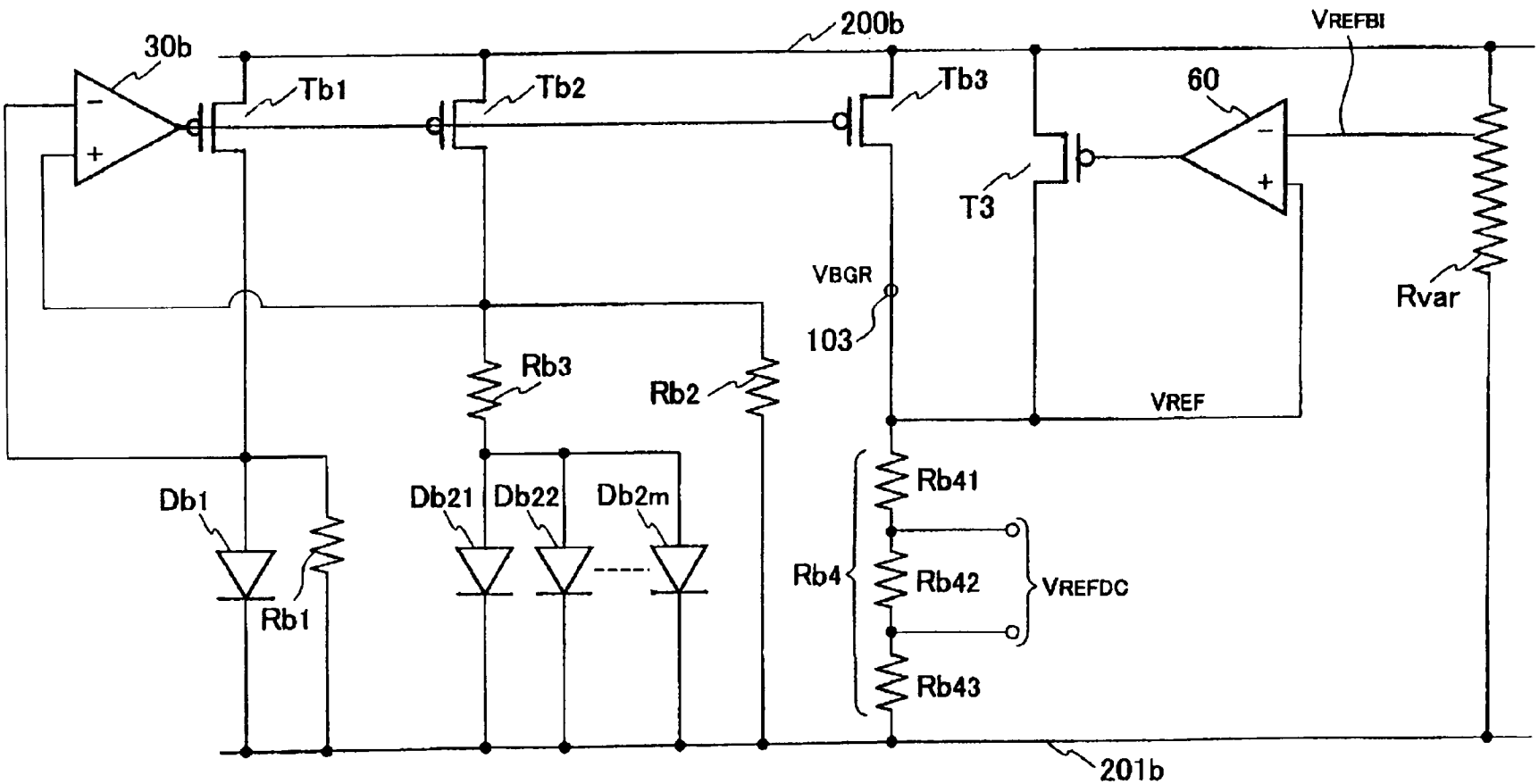
FIG. 7 is a schematic drawing showing the configuration of a reference voltage generation circuit according to a second embodiment.

A reference voltage generation circuit according to a second embodiment differs from the reference voltage generation circuit of the first embodiment in that it further includes a second operational amplifier 60 and a third PMOS transistor T3, as shown in FIG. 7. To the second operational amplifier 60, a voltage $V_{REFBI}$ provided by dividing power supply voltage VDD by a resistor and a reference voltage $V_{BGR}$ are input. A gate electrode of the third PMOS transistor T3 is connected to an output terminal of the second operational amplifier 60. The reference voltage generation circuit shown in FIG. 7 outputs a voltage $V_{REF}$ and a voltage $V_{REFDC}$ based on the reference voltage $V_{BGR}$ output from the reference voltage generation circuit shown in FIG. 4.

The voltage $V_{REFBI}$ is provided as the voltage difference between a power supply line 200*b* and a ground line 201*b* is divided by a variable resistor Rvar shown in FIG. 7. The voltage $V_{REFBI}$ can be changed by changing the resistance division ratio. The second operational amplifier 60 makes a comparison between the voltage $V_{REFBI}$ and the reference voltage $V_{BGR}$. And, the second operational amplifier 60 controls a third PMOS transistor T3 based on the comparison result, as described later.

As shown in FIG. 7, a drain electrode of the third PMOS transistor T3 and a plus input terminal of the second operational amplifier 60 are connected to a connection node 103. The voltage of the connection node 103 is input to the plus input terminal of the second operational amplifier 60 and the voltage $V_{REFBI}$ is input to a minus input terminal of the second operational amplifier 60.

If the voltage of the minus input terminal of the second operational amplifier 60 is lower than the voltage of the plus input terminal, the second operational amplifier 60 outputs high. If the voltage of the minus input terminal is higher than the voltage of the plus input terminal, the second operational amplifier 60 outputs low. When the second operational amplifier 60 outputs high, the third PMOS transistor T3 is turned off; when the second operational amplifier 60 outputs low, the third PMOS transistor T3 is turned on. This means that the third PMOS transistor T3 is turned off when the voltage $V_{REFBI}$ is lower than the voltage of the connection node 103, and that the third PMOS transistor T3 is turned on when the voltage $V_{REFBI}$ is higher than the voltage of the connection node 103. That is, when $V_{REFBI}<V_{BGR}$, $V_{REF}=V_{BGR}$ is output as the reference voltage; when $V_{REFBI}>V_{BGR}$, $V_{REF}=V_{REFBI}$ is output as the reference voltage.

A source electrode of the third PMOS transistor T3 is connected to the power supply line 200*b* and a resistor Rb4 is connected to the drain electrode. When the third PMOS transistor T3 is turned on, an electric current is supplied from the power supply line 200*b* through the third PMOS transistor T3 to the resistor Rb4. This means that the third PMOS transistor T3 supplies an electric current to the resistor Rb4 under the control of the second operational amplifier 60. As shown in FIG. 7, the resistor Rb4 connected between the connection node 103 and the ground line 201*b* is divided and the voltage $V_{REFDC}$ is set. The resistor Rb4 is divided into resistors Rb41 to Rb43 to make the voltage $V_{REFDC}$ from the voltage $V_{REF}$, and functioning as an output adjusting section.

Figure 8:
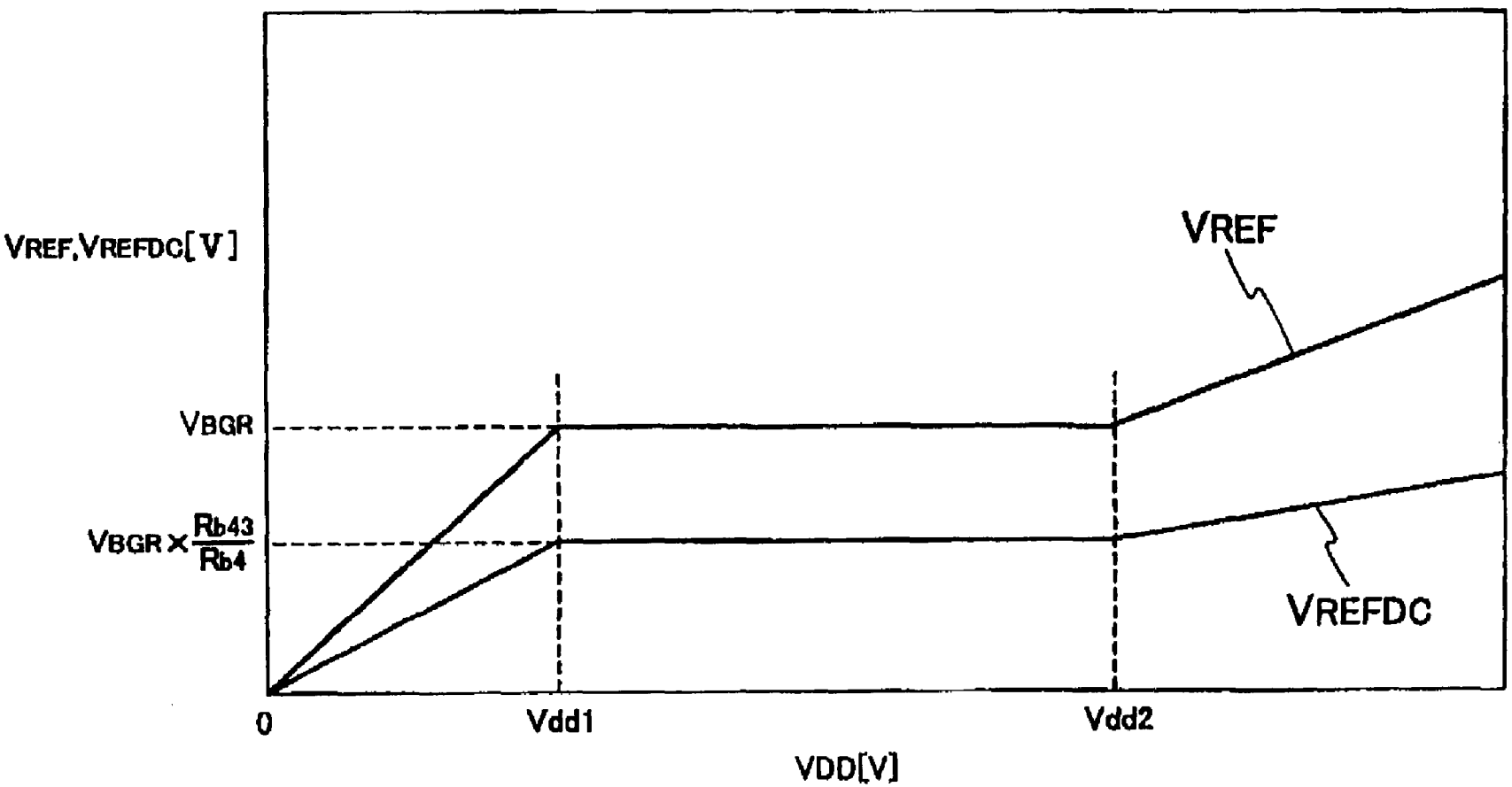
FIG. 8 is a graph showing the relationship between the reference voltage output by the reference voltage generation circuit according to the second embodiment and power supply voltage.

FIG. 8 shows dependence of the voltage $V_{REF}$ and the voltage $V_{REFDC}$ on the power supply voltage VDD supplied from the power supply line 200*b*. As the power supply voltage VDD rises from 0 V, the voltage of the connection node 103 rises and the voltage $V_{REF}$ and the voltage $V_{REFDC}$ rise. When the power supply voltage VDD reaches a voltage Vdd1, the voltage of the connection node 103 becomes constant at the reference voltage $V_{BGR}$ and the voltage $V_{REF}$ and the voltage $V_{REFDC}$ become constant at the voltage $V_{BGR}$ and voltage $V_{BGR}$×Rb43/Rb4 respectively. The voltage Vdd1 is the voltage of the power supply line 200*b* at which the voltage of the connection node 103 reaches the reference voltage $V_{BGR}$. Then, the voltage $V_{REF}$ and the voltage $V_{REFDC}$ are maintained at constant values regardless of rise in the power supply voltage VDD until the power supply voltage VDD reaches a voltage Vdd2. The voltage Vdd2 is the voltage of the power supply line 200*b* at which the voltage $V_{REFBI}$ becomes equal to the reference voltage $V_{BGR}$.

When the power supply voltage VDD becomes the voltage Vdd2 or more, the voltage $V_{REFBI}$ becomes equal to or larger than the reference voltage $V_{BGR}$, and the voltage $V_{REF}$ and the voltage $V_{REFDC}$ rise with the rise in the power supply voltage VDD, as shown in FIG. 8.

For example, in a burn-in test of a semiconductor integrated circuit, the voltage $V_{REF}$ and the voltage $V_{REFDC}$ can be used as the reference voltage of the semiconductor integrated circuit to be subjected to the burn-in test. Thus, the voltage $V_{REFBI}$ is set based on the test condition, etc., of the burn-in test of a semiconductor integrated circuit. As the voltage $V_{REFBI}$ is adjusted, the reference voltage generation circuit shown in FIG. 7 can output any desired voltage $V_{REF}$ and voltage $V_{REFDC}$.

THIRD EMBODIMENT

Figure 9:
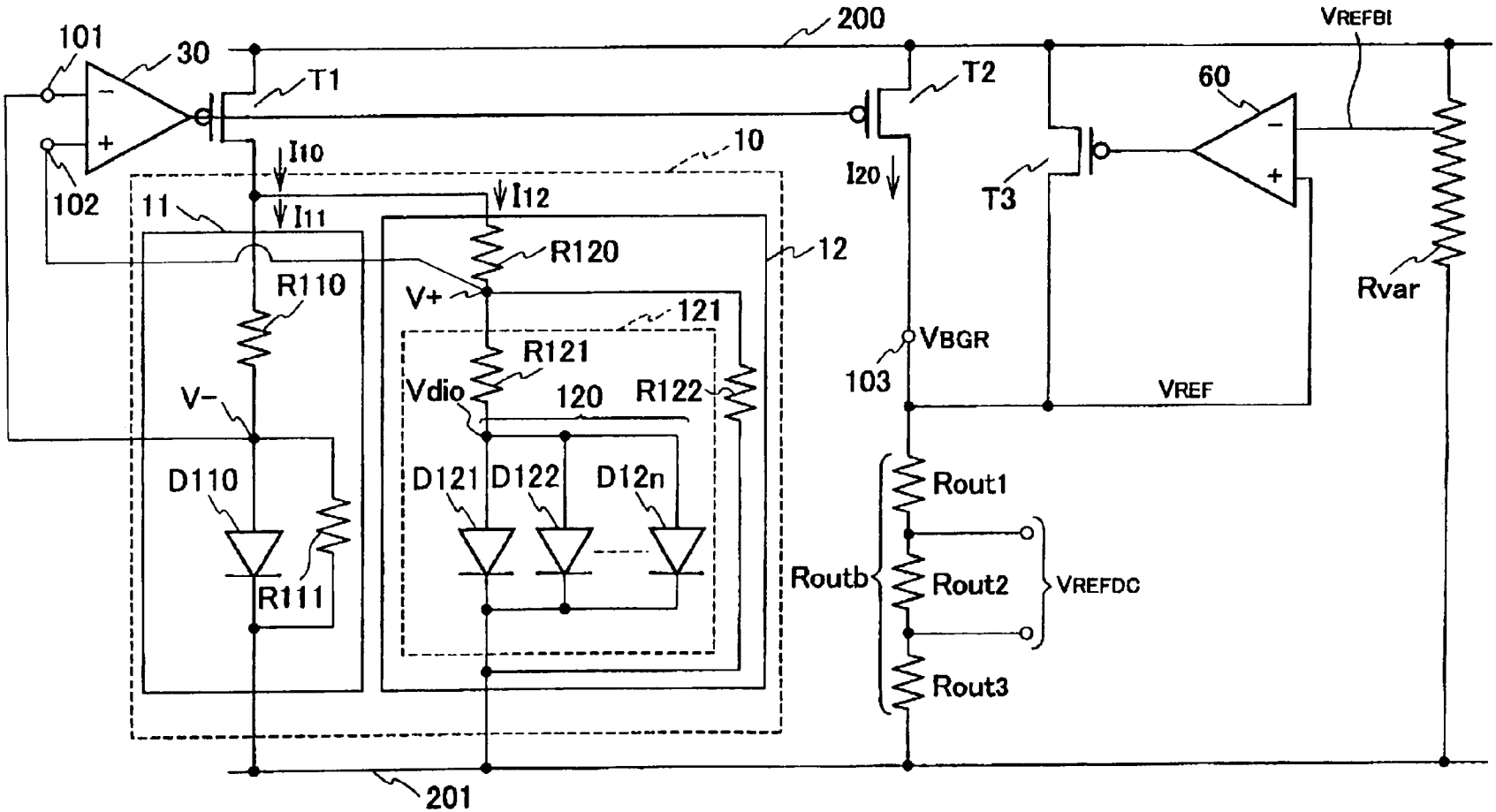
FIG. 9 is a schematic drawing showing the configuration of a reference voltage generation circuit according to a third embodiment.

A reference voltage generation circuit according to a third embodiment differs from the reference voltage generation circuit according to the first embodiment shown in FIG. 5 in that it further includes a second operational amplifier 60 and a third PMOS transistor T3, as shown in FIG. 9. To the second operational amplifier 60, a voltage $V_{REFBI}$ provided by dividing power supply voltage VDD by a resistor and a reference voltage $V_{BGR}$ are input. The third PMOS transistor T3 has a gate electrode connected to an output terminal of the second operational amplifier 60 and a drain electrode connected to a connection node 103. The reference voltage generation circuit shown in FIG. 9 outputs a voltage $V_{REF}$ and a voltage $V_{REFDC}$ based on a reference voltage $V_{BGR}$.

A plus input terminal of the second operational amplifier 60 is connected to the connection node 103, a voltage $V_{REFBI}$ is connected to a minus input terminal, and output of the second operational amplifier 60 is input of a gate electrode of a third PMOS transistor T3.

In the reference voltage generation circuit shown in FIG. 9, the second operational amplifier 60 makes a comparison between the voltage $V_{REFBI}$ and the reference voltage $V_{BGR}$ and controls the third PMOS transistor T3 based on the comparison result as in the reference voltage generation circuit shown in FIG. 7.

A source electrode of the third PMOS transistor T3 is connected to a power supply line 200 and an output resistor $R_{outb}$ is connected to the drain electrode. When the third PMOS transistor T3 is turned on, an electric current is supplied from the power supply line 200 through the third PMOS transistor T3 to the output resistor $R_{outb}$. This means that the third PMOS transistor T3 supplies an electric current to the output resistor $R_{outb}$ under the control of the second operational amplifier 60.

As shown in FIG. 9, the output resistor $R_{outb}$ is divided and the voltage $V_{REFDC}$ is set. The resistor $R_{outb}$ is divided into resistors $R_{out1}$ to $R_{out3}$ to make the voltage $V_{REFDC}$ from the voltage $V_{REF}$, and functioning as an output adjusting section.

Figure 10:
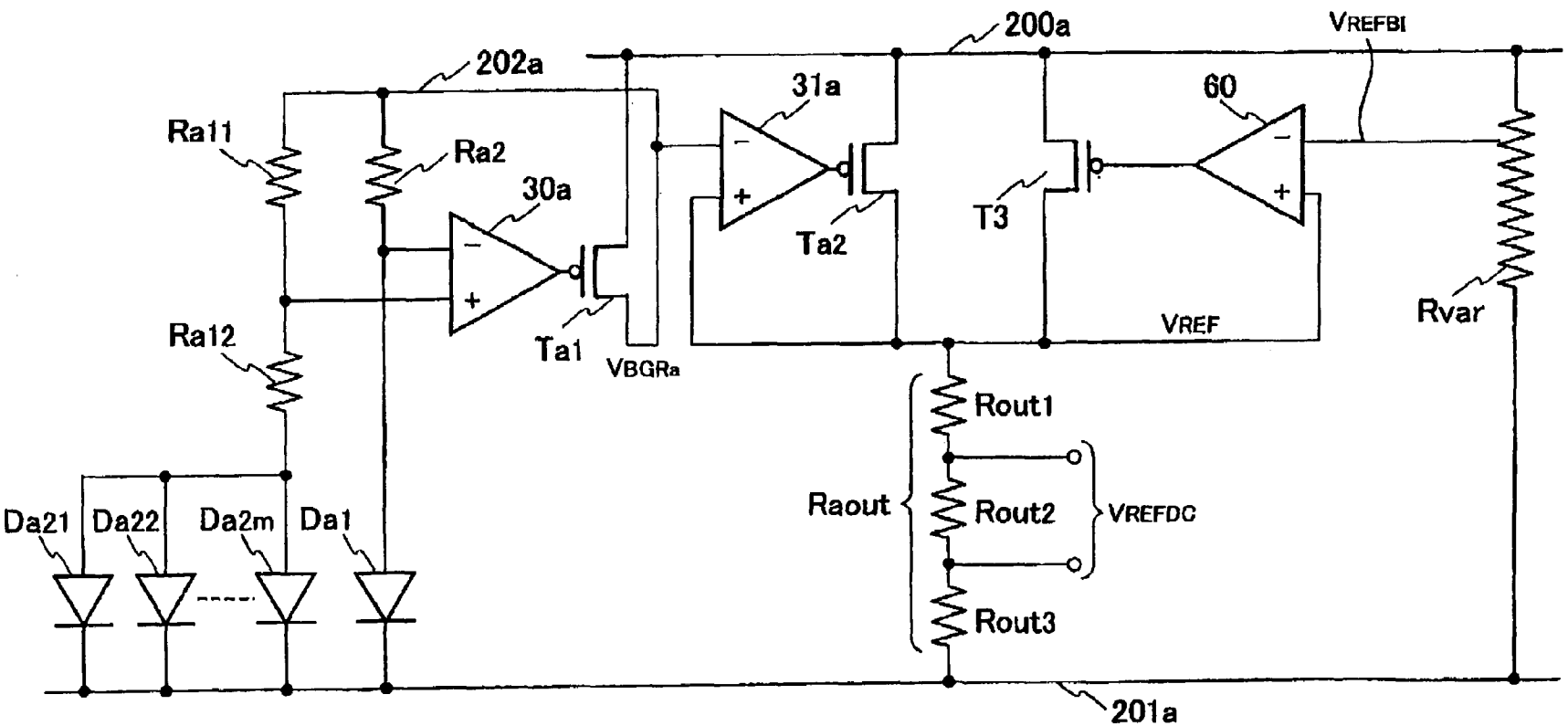
FIG. 10 is a schematic drawing showing a configuration example of a reference voltage generation circuit according to a fourth comparison example.
Figure 11:
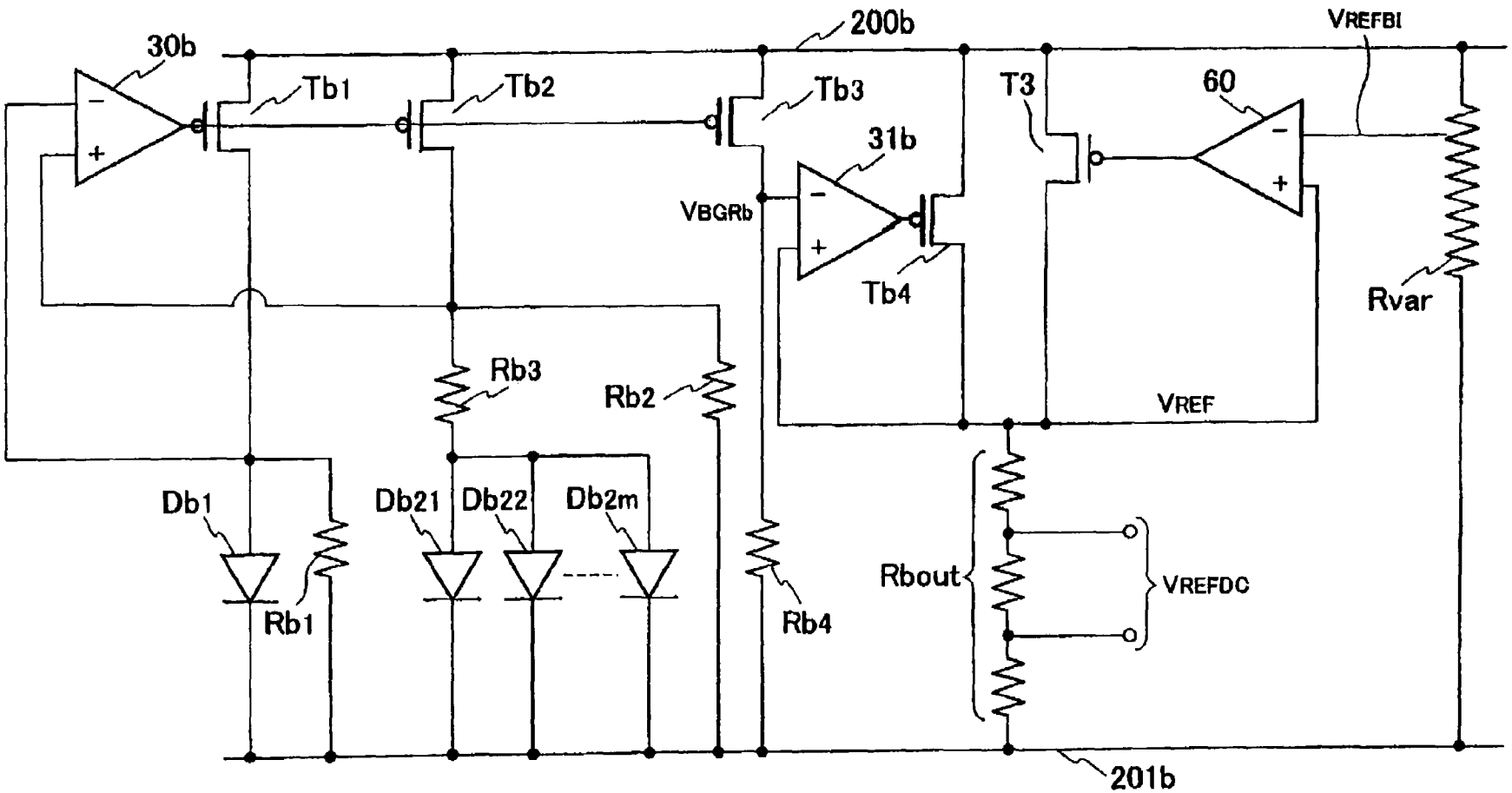
FIG. 11 is a schematic drawing showing a configuration example of a reference voltage generation circuit according to a fifth comparison example.

For comparison, FIGS. 10 and 11 show reference voltage generation circuits according to fourth and fifth comparison examples for outputting voltage $V_{REF}$ and voltage $V_{REFDC}$ using third PMOS transistor T3, variable resistor Rvar, and second operational amplifier 60.

The reference voltage generation circuit shown in FIG. 10 includes an operational amplifier 31*a* and a PMOS transistor Ta2 and outputs voltage $V_{REF}$ and voltage $V_{REFDC}$ based on the reference voltage $V_{BGR}$ shown in FIG. 2. The reference voltage $V_{BGR}$ is output to a minus input terminal of the operational amplifier 31*a*. A plus input terminal of the operational amplifier 31*a*, a drain electrode of the transistor Ta2, a drain electrode of the third PMOS transistor T3, and a plus input terminal of the second operational amplifier 60 are connected to one end of a resistor $Ra_{out}$. An opposite end of the resistor $Ra_{out}$ is connected to a ground line 201*a*. A power supply line 200*a* is connected to a source electrode of the PMOS transistor Ta2 and output of the operational amplifier 31*a* is input to a gate electrode of the PMOS transistor Ta2. In the reference voltage generation circuit shown in FIG. 10, the voltage $V_{REFDC}$ is set by dividing the resistor $Ra_{out}$.

In the reference voltage generation circuits according to the second and third embodiments shown in FIGS. 7 and 9, the number of the operational amplifiers is reduced as compared with the reference voltage generation circuit according to the fourth comparison example shown in FIG. 10. Generally, the operational amplifier uses, for example, 5 or more transistors. Since the number of the operational amplifier is reduced, the number of the circuit elements (transistors) of the reference voltage generation circuits according to the second and third embodiments can be reduced.

The reference voltage generation circuit shown in FIG. 11 includes an operational amplifier 31*b* and a PMOS transistor Tb4 and outputs voltage $V_{REF}$ and voltage $V_{REFDC}$ based on the reference voltage $V_{BGR}$ shown in FIG. 3. The reference voltage $V_{BGR}$ is output to a minus input terminal of the operational amplifier 31*b*. A plus input terminal of the operational amplifier 31*b*, a drain electrode of the PMOS transistor Tb4, a drain electrode of the third PMOS transistor T3, and a plus input terminal of the second operational amplifier 60 are connected to one end of a resistor $Rb_{out}$. An opposite end of the resistor $Rb_{out}$ is connected to a ground line 201*b*. A power supply line 200*b* is connected to a source electrode of the PMOS transistor Tb4 and output of the operational amplifier 31*b* is input to a gate electrode of the PMOS transistor Tb4. In the reference voltage generation circuit shown in FIG. 11, the voltage $V_{REFDC}$ is set by dividing the resistor $Rb_{out}$.

The number of the circuit elements (transistors) of reference voltage generation circuits according to the second and third embodiments shown in FIGS. 7 and 9 can be reduced as compared with the reference voltage generation circuit according to the fifth comparison example shown in FIG. 11.

As described above, according to the reference voltage generation circuits according to the second and third embodiments, as the voltage $V_{REFBI}$ is adjusted, any desired voltage $V_{REF}$ and voltage $V_{REFDC}$ can be generated based on the reference voltage $V_{BGR}$. Also, according to the reference voltage generation circuits according to the second and third embodiments, the number of the elements is decreased, so that the voltage $V_{REF}$ and the voltage $V_{REFDC}$ less affected by the threshold voltage variations of the transistors can be output. Others are substantially similar to those of the first embodiment and duplicate description will not be given.

OTHER EMBODIMENTS

Although the invention has been described with the first to third embodiments, it is to be understood that the description and the drawings forming parts of the disclosure do not limit the invention. From the disclosure, various alternative embodiments, examples, and operational arts will be apparent to those skilled in the art.

In the first to third embodiments described above, the diodes D121 to D12*n* each equaling the first diode D110 in energization area are connected in parallel to make up the second diode D120 by way of example. However, the second diode D120 may be a diode whose energization area is n times that of the first diode D110.

Thus, the invention contains various embodiments, etc., not described herein, of course. Therefore, the technical scope of the invention is to be determined solely by the inventive concepts which are delineated by the claims adequate from the description given above.

According to an aspect of the present invention, there is provided a reference voltage generation circuit that outputs a reference voltage less affected by the threshold voltage variations of transistors and that operates on a low power supply voltage.

What is claimed is:

1. A reference voltage generation circuit comprising:

a first transistor comprising:
- a first gate,
- a first source, and
- a first drain;

a second transistor comprising:
- a second gate connected to the first gate,
- a second source connected to the first source, and
- a second drain;

a first diode connected between a ground level and a V− node;

a first resistor connected between the V− node and the first drain;

a second diode connected between the ground level and a Vdio node;

a second resistor connected between the Vdio node and a V+ node;

a third resistor connected between the V+ node and the first drain;

a first operational amplifier comprising:
- a first plus input port connected to the V+ node,
- a first minus input port connected to the V− node, and
- a first output port connected to the first gate and the second gate;

a fourth resistor connected between the ground level and the second drain;

an output terminal disposed between the second drain and the fourth resistor;

a third transistor comprising:
- a third gate,
- a third source, and
- a third drain connected to the output terminal;

a second operational amplifier comprising:
- a second plus input port connected to the output terminal,
- a second minus input port connected to a power supply voltage via a variable resistor that is disposed between the power supply voltage and the ground level, and
- a second output port connected to the third gate.

2. The reference voltage generation circuit according to claim 1, wherein the first transistor and the second transistor comprise a P-channel MOS transistor.

3. The reference voltage generation circuit according to claim 1, wherein the second diode comprises a plurality of diodes, each of which has the same characteristic as the first diode.

4. The reference voltage generation circuit according to claim 1, wherein resistance values of the first resistor and of the third resistor are equal.

5. The reference voltage generation circuit according to claim 1 further comprising:

a fifth resistor connected between the ground level and the V− node; and a sixth resistor connected between the ground level and the V+ node.

6. The reference voltage generation circuit according to claim 5, wherein resistance values of the fifth resistor and of the sixth resistor are equal.

7. The reference voltage generation circuit according to claim 1, wherein the fourth resistor comprises an output adjusting section that divides a voltage supplied thereon.

* * * * *